US007026888B2

(12) United States Patent
Antkowiak

(10) Patent No.: US 7,026,888 B2
(45) Date of Patent: Apr. 11, 2006

(54) BROADBAND NON-DIRECTIONAL TAP COUPLER

(76) Inventor: Marek Edward Antkowiak, 275 Garfield St., Berkeley Heights., NJ (US) 07922

( * ) Notice: Subject to any disclaimer, the term of this patent is extended or adjusted under 35 U.S.C. 154(b) by 31 days.

(21) Appl. No.: 10/832,058

(22) Filed: Apr. 26, 2004

(65) Prior Publication Data

US 2004/0222867 A1 Nov. 11, 2004

Related U.S. Application Data

(60) Provisional application No. 60/467,321, filed on May 5, 2003.

(51) Int. Cl.
*H01P 5/12* (2006.01)

(52) U.S. Cl. ..... 333/127; 333/121; 333/123

(58) Field of Classification Search ..... 333/127, 333/128, 123, 121, 109, 115
See application file for complete search history.

(56) References Cited

U.S. PATENT DOCUMENTS 2,643,296 A * 6/1953 Hansen ..... 333/127
2,763,777 A * 9/1956 Smullin ..... 455/310
3,324,421 A * 6/1967 Fujimoto ..... 333/127
3,735,293 A * 5/1973 Breitenbach ..... 333/237
4,859,971 A * 8/1989 Edwards et al. ..... 333/109
5,132,646 A * 7/1992 Faxon ..... 333/121
5,689,218 A * 11/1997 Stein et al. ..... 333/125
5,801,600 A * 9/1998 Butland et al. ..... 333/127
5,978,199 A * 11/1999 Germann et al. ..... 361/119
6,162,991 A * 12/2000 Tayama et al. ..... 174/71 C

* cited by examiner

*Primary Examiner*—Robert Pascal
*Assistant Examiner*—Kimberly Glenn
(74) *Attorney, Agent, or Firm*—St. Onge Steward Johnston & Reens LLC

(57) ABSTRACT

A high power, non-directional tap coupler having low loss and expanded bandwidth using a novel airline coaxial line structure. Each of the main and secondary conductors forms a concentric structure of constant dimension over a substantial length inside a metallic housing. The coupled port conductor is connected perpendicularly at the middle point to the secondary conductor. The conductors form a novel structure in which coupling remains relatively constant over a broadband frequency range and main line VSWR remains low. The result is a non-directional tap coupler with a wideband operational frequency, a reduced physical size, and low loss and with good PIM performance.

11 Claims, 4 Drawing Sheets

| Transmission Line Model FIG 8 | Inner Conductor Diameter [inches] | Outer Conductor Diameter [inches] | Length [inches] |
|---|---|---|---|
| 850 | .222 | .414 | 1.775 |
| 851 | .464 | .625 | 1.775 |
| 852 | .205 | .312 | .312 |
| 853 | .271 | .625 | .526 |

BROADBAND NON-DIRECTIONAL TAP COUPLER

CROSS REFERANCE TO RELATED APPLICATION

This utility patent applications claims priority status over previously filed provisional patent application titled "Broadband non-directional tap coupler" No. 60/467321 filed on May 5, 2003.

FIELD OF THE INVENTION

The invention relates to microwave devices, particularly to an unequal power divider for use in high power operation over wide bandwidth to divide/combine RF power in unequal ratios and to methods of making same.

BACKGROUND INFORMATION

The term "tap coupler" refers in general to a three-port passive microwave device used in microwave art to divide power in an input path into two output paths.

The split of the input signal between output ports can be of equal or unequal value. In equal division, the power at the each of the two output ports is equal to the half of the input power and the ratio of output power, termed as split ratio, R, is 1:1 or 1 where one of the output ports has been standardized to 1. In the case of an unequal divider, the input signal is split into two output ports, such that the R-value is greater than 1.

Known power couplers include Lange coupler, branch line coupler, directional couplers, split-tee coupler and the Wilkinson coupler among others. U.S. Pat. No. 4,254,386 for a Three Way Equal-Phase Combiner/Divider Network Adapted for External Isolation Resistors is illustrative of several of these types of couplers.

U.S. Pat. No. 5,889,444 for a Broadband Non-Directional Tap Coupler shows further advance of the art in expanding bandwidth and manufacturability of such devices using a split-tee, five sections per arm design.

The directional coupler structures include single section, multiple section and tapered designs, among others. A comprehensive summary of such structures is provided in M. A. R. Gunston, "Microwave Transmission Line Data", Noble Publishing, 1997, ISBN 1-884932-57-6. Gunston describes coupled transmission lines with coupled conductors of circular as well as rectangular cross sections. J. A. G. Malherbe, "Microwave Transmission Line Couplers", Artech House, 1988, ISBN 0-89006-300-1 describes couplers with tapered conductors.

The need for unequal power dividers arises from the increased requirement for broadband, distributed, high power transmission line systems. U.S. Pat. No. 5,889,444 for a Broadband Non-Directional Tap Coupler describes familiar distribution line systems as a coaxial cable network, which brings cable signals to multiple TV sets. In more sophisticated systems, such as in-building bi-directional passive antenna distribution systems, transmitting and receiving signals of many services operating at different frequencies is desired. In this application, a main coaxial cable carries signals from a base station or off-air repeater located in the building to be distributed throughout the building. To add the branch lines to the main coaxial cable, and provide signal to the different floors, non-directional tap couplers are required. If each floor is to receive the same amount of power, the split ratio of the tap coupler should be adjusted at each floor. The split ratio used is between 3 dB (R of 1:1) and 30 dB (R of 1:999) for a typical in-building installation application.

Some difficulties associated with providing non-directional couplers for such an application are as follows. First, it is difficult to provide a tap coupler that can maintain a constant coupling value over a broadband frequency range. Second, it is difficult to provide a non-directional tap coupler where the input port voltage standing wave ratio (VSWR) is kept low or close to the minimum value of 1. VSWR is the ratio of the maximum voltage to minimum voltage on the transmission line. As known, when the load, such as the input of the tap-coupler, matches the characteristic impedance of the line, such as coaxial cable used to feed signal into tap coupler, there is no reflected wave present, so Vmax=Vmin and VSWR is 1. It is important to keep VSWR low to keep losses associated with the mismatch of the device to a minimum. Further, it is very difficult to provide a non-directional tap coupler that can handle high power and have low Passive Intermodulation Distortion Products (PIM). Furthermore, it is difficult to provide a non-directional tap coupler working over a wideband frequency range that provides physically realizable characteristic transmission line impedance values.

The present invention overcomes the shortcomings of prior art with a single section, compact, high power coaxial structure with a practical characteristic impedance range and achieves very good PIM performance with a high power rating.

SUMMARY OF THE INVENTION

The object of this invention is a non-insulated power divider, working over a broadband frequency range.

It is the further object of the invention, to provide a tap coupler in which size and component count is minimized in order to provide a low cost solution suited to high volume production.

It is yet another object of this invention to provide a non-directional tap coupler using novel airline coaxial transmission line structures, having very low dissipative loss and high RF power handling over a broadband frequency range.

Also, it is the object of the invention to provide a non-directional tap coupler in which input line return loss is kept to minimum over a broadband frequency range, and in which the coupling value remains constant over the same broadband frequency range.

The invention provides a coupler having negligible passive inter-modulation distortion product (PIM).

The invention provides a non-directional tap coupler of rugged, mechanically stable construction applicable to indoor and outdoor applications where mechanical stress as well as environmentally stressful conditions are present.

A further object of the invention is to provide a non-directional tap coupler having split ratios where R essentially is of any value between 1:1 and 1:999.

The invention describes a method of extending the frequency bandwidth and power handling capacity of a non-directional tap coupler by means of novel transmission line structures. In an exemplary embodiment, the input port is directly connected onto one of the output ports using airline coaxial transmission line. The metallic, concentric cylinder, forming another single transmission line structure, surrounds this coaxial line and is connected to the second output port. The second output port is connected at the midpoint of the cylindrical conductor. This embodiment provides a novel, single section structure that has very broadband coupling characteristics. Prior art would require a multiple section coupling structure with varying characteristic impedance in order to achieve comparable flat coupling bandwidth characteristics.

The present invention also provides practical methods for making the novel non-directional tap couplers. The invention has accomplished the further benefits of decreased cost, simplicity, and accurate repeatability.

The aforementioned aspects of the invention have resulted in a non-directional tap coupler with exceptional bandwidth, having a very low dissipative loss and a high power rating. Couplers produced, using this design, enjoy a lower manufacturing cost than conventional structures of equivalent performance.

DETAILED DESCRIPTION

Figure 1:
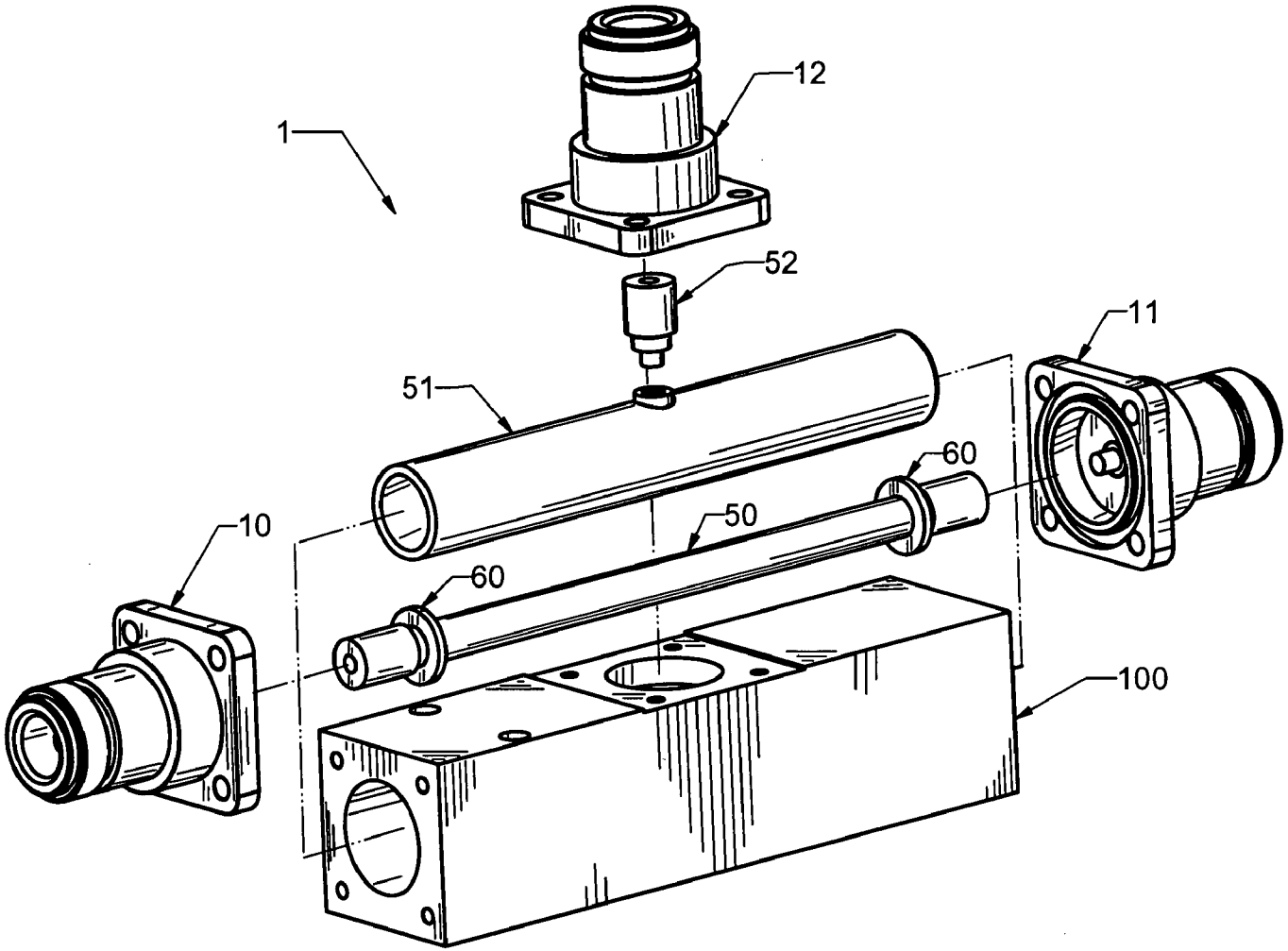
FIG. 1 shows exploded view of the coupler, which is the embodiment of the technique of the present invention.
Figure 2:
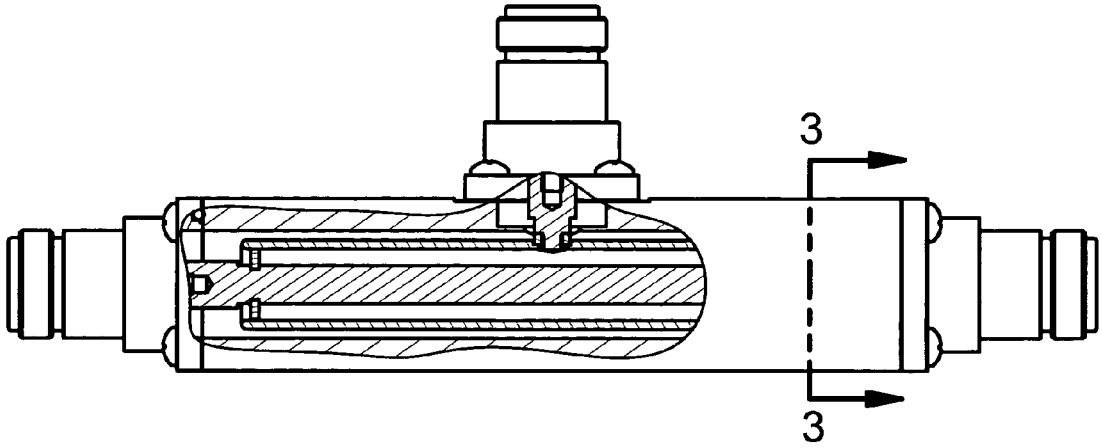
FIG. 2 shows planar view and additional cross-section of a coaxial coupler in accordance with the design
Figure 3:
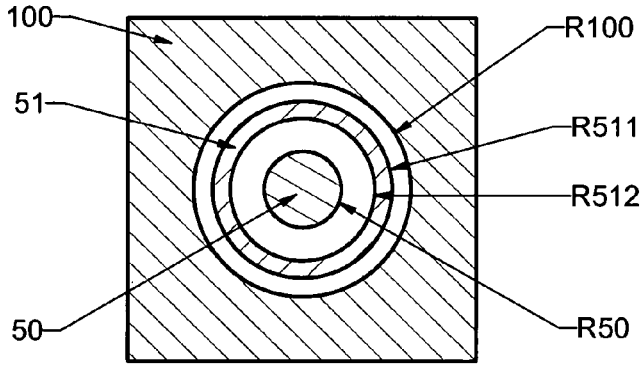
FIG. 3 shows an additional cross-section as designated on FIG. 2.

The cross section view of the embodiment of a non-directional tap coupler (1) of the present invention is shown on FIG. 1, FIG. 2 and FIG. 3. The broadband non-directional tap coupler (1) includes a housing (100) and input, output and coupled port coaxial connectors (10), (11) and (12). The broadband non-directional tap coupler also includes a main line conductor (50), which is positioned concentrically inside the secondary conductor (51) and supported by dielectric discs (60). Both the main conductor (50) and secondary conductor (51) are positioned inside a concentric hole drilled in the housing (100). The coupled port coaxial connector (12) is coupled to the secondary conductor (51) using side arm conductors (52). In the embodiment shown, the side conductor (52) is coupled to the secondary conductor (51) at the mid point along the length of the secondary conductor (51). The middle position of the tap point along the secondary conductor can be further adjusted to yield additional variations to the present invention. Additionally, the number of output ports connected to the secondary conductor (51) can be increased to get additional topologies of two, three, or four way unequal non-directional tap couplers. The main conductor (50) and secondary conductor (51) are electrically separated from each other and provide no DC continuity between input (10) and the coupled port (12). The space between conductors inside housing (100) may be occupied by dielectric material, such as air, a gas, or vacuum. With this invention, using air, gas or a vacuum as a dielectric in the coupler minimizes the transmission loss of the coupler associated with the microwave dielectric loss tangent.

As will be described hereinafter, the length of the secondary conductor is significant in determining the frequency of operation of this invention, whereas radiuses R100, R511, R512 and R50 are selected to obtain the required split value R and maintain a good main line VSWR.

FIG. 3 shows a cross section of the concentric structure formed by the embodiment of the present invention. What is shown is a concentric arrangement of the main conductor (50) inside secondary cylindrical conductor (51), which is in turn positioned concentrically inside housing (100). The main conductor (50) shown in this section forms an airline coaxial line structure, where the inner conductor radius is R50 and outer conductor radius is R512. The characteristic impedance of this transmission line section is close to 50 ohms, the systems characteristic impedance, and provides a good match with low VSWR value over a wideband frequency range.

The outside diameter R511 of the secondary conductor (51) forms yet another transmission line structure wherein the outer conductor radius is R100 and the inner conductor radius is R511.

The side conductor (52) is a simple airline coaxial transmission line structure. Impedance of the side conductor (52) is selected during computer optimization of the present invention and selected to yield acceptable coupling flatness over a wideband frequency range.

In an exemplary embodiment, the housing (100) is manufactured from aluminum, whereas conductors (50), (51) and (52) are made out of brass. The bodies of the connectors (10), (11) and (12) are made out of brass, whereas the center conductors of such connectors are made out of beryllium copper. The insulator used in these connectors is PTFE dielectric.

The conductive material used, may include brass, aluminum, beryllium copper, etc. and may be protected against corrosion using electrically conductive plating (e.g., silver plating) or chemical conversion coating (iridite). Silver-plating the parts will provide the lowest loss and best passive inter-modulation (PIM) performance of this invention.

Figures 8, 9:
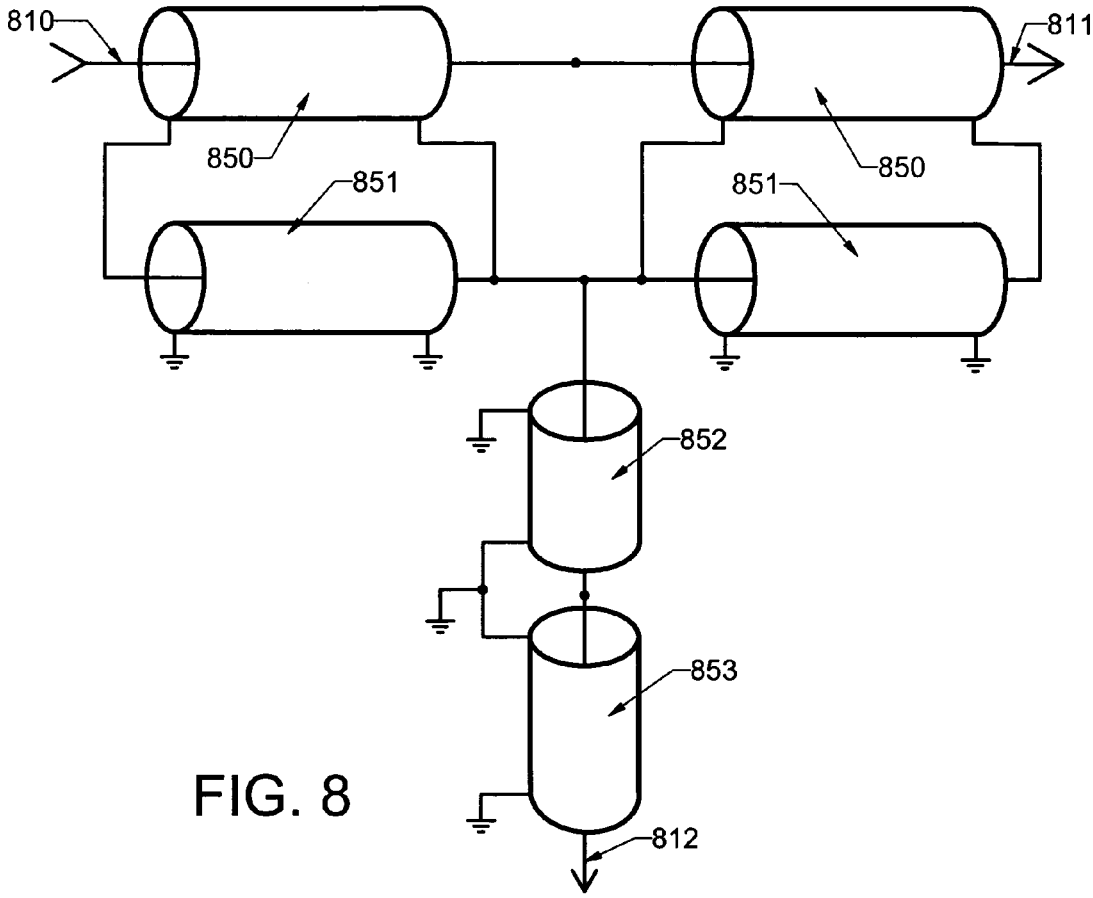
FIG. 8 shows the electrically equivalent circuit of the non-directional tap coupler of the present invention.
FIG. 9 shows example of the dimensions used to manufacture a 1:20 non-directional tap coupler with this technique.

FIG. 8 shows an electrically equivalent circuit of the non-directional tap coupler utilizing the techniques described in the invention. This equivalent circuit can be used by those skilled in the art to accomplish optimization of the parameters of this invention and design a non-directional tap coupler in which coupling values can be selected as desired. Any commercially available microwave circuit simulator can be used to design such a non-directional tap coupler.

The main conductors (50) along with the secondary conductor (51) are modeled as two-pieces of the transmission line (850) and (851) respectively. The side conductor (52) is modeled as two transmission line segments, (852) and (853). The transmission line (852) is used to accurately simulate transition of the side conductor (52) through the side hole drilled in the housing (100) to access junction at the secondary conductor (51). The inner radius of the coaxial model (850) is equal to R50, whereas outer conductor radius is equal to R512. The outer radius of the coaxial model (851) is equal to R100, whereas the inner conductor radius is equal to R511. It should be noted, that the radius R511 is related to radius R512 by the wall thickness of the secondary conductor (51). The coaxial transmission line section (853) is essentially 50-ohm characteristic impedance. This short section of the transmission line can be used further to adjust the slope of the coupling. This adjustment may be necessary to compensate for parasitic impedance of the junction formed by the side conductor (52) and secondary conductor (51). The length of the coaxial lines (850) and (851) is equal.

The following is a detailed design procedure used by those skilled in the art to design a non-directional tap coupler of the present invention.

First, the required frequency range, power rating, connector type and split ratio R must be specified. The typical connectors used in such applications are N, DIN 7/16, or any combination. Based on the connector used, the radius R100 is selected to provide a good transition from the connector to the housing. Next, the wall thickness of the secondary conductor is selected. In the present invention, the wall thickness is constant for all split ratios, and is equal to 0.050". This thickness is sufficient to provide a mechanically stable junction for the connection of the side conductor (52) to the secondary conductor (51). Next the simulation project is set up using the block diagram shown in FIG. 8. The constant values are R100 and wall thickness (defined as the difference between radius R511 and R512). The variables are radius R50, R512 and the length of the coaxial lines (850). The optimizer is used to adjust variables in order to achieve the proper split ratio and best possible input VSWR. The simplest way to perform optimization is to convert the output split ratio into a value in dB. For example, the split ratio R of the 1:4 is equivalent to the coupling value of −6.99 dB as referenced from the input port. This value is then used as a goal in the circuit simulator for the insertion loss measurement between the input and output and coupled ports.

FIG. 9 shows the final simulation results for the design of the 1:20 divider. The R of 1:20 is equivalent to −13.22 dB coupling value as reference to the input port. The design frequency was 370 to 2700 MHz.

It should be noted, that at the operating frequency, at which half wavelength is equal to the electrical length of the secondary conductor (51), there would be a resonance affecting the performance of this invention. The length of the secondary conductor (51) is selected to be equal to 3.55 inches, which corresponds to a resonance frequency close to 1650 MHz. This resonant frequency is between currently used wireless bands and does not have a negative effect on the performance of this invention.

Figure 4:
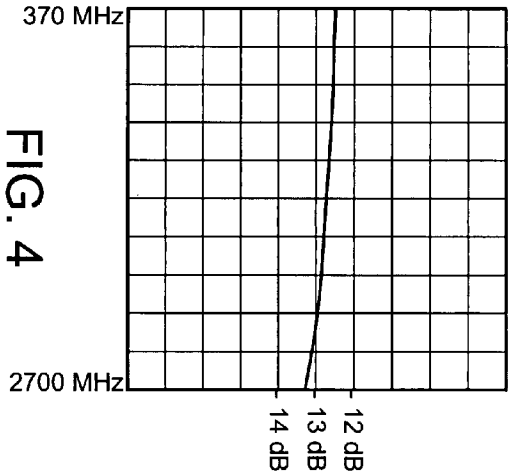
FIG. 4 shows a graphic view of the coupling measurement of the device with a coupling value of 1:20. This is a non-directional tap coupler designed to operate across a frequency range between 370 MHz to 2700 MHz using the techniques described herein.
Figure 5:
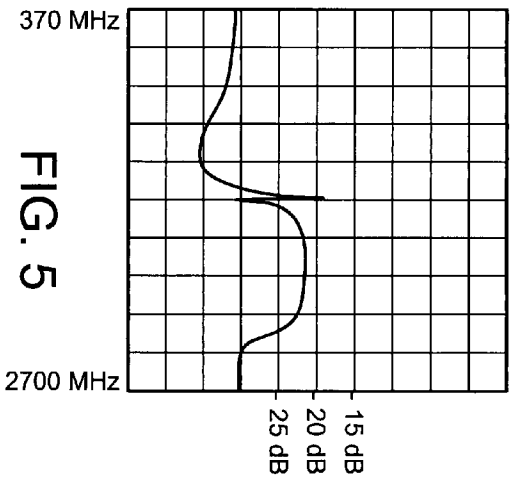
FIG. 5 shows the input return loss value for the 1:20 non-directional tap coupler over the 370 MHz to 2700 MHz frequency range.

FIG. 4 and FIG. 5 illustrate measured results of the non-directional tap coupler, constructed in accordance with the present invention. FIG. 4 shows that the coupling value is kept essentially constant and equal to the −13.0+/−0.7 dB value over 370 to 2700 MHz. FIG. 5 illustrates that the input return loss of the same non-directional tap coupler is kept below −20.8 dB, which corresponds to the VSWR of better than 1.2

Figure 6:
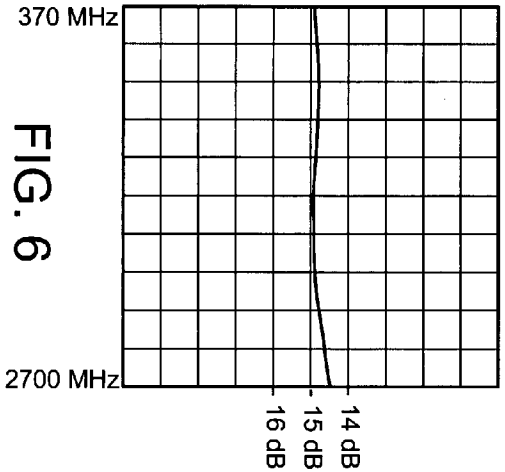
FIG. 6 shows the coupling value for the 1:30 non-directional tap coupler over the 370 MHz to 2700 MHz frequency range.
Figure 7:
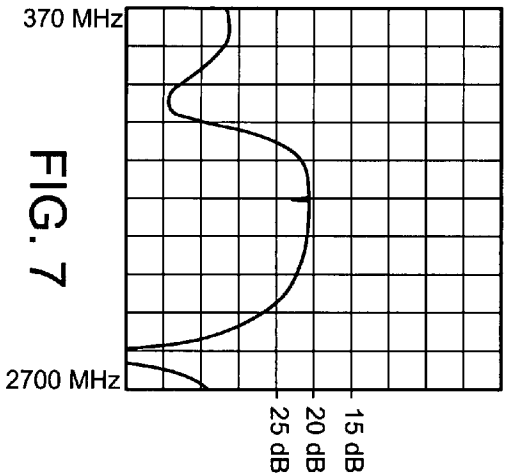
FIG. 7 shows the input return loss value for a 1:30 non-directional tap coupler, designed with the techniques described herein, over the 370 MHz to 2700 MHz frequency range.

FIG. 6 and FIG. 7 illustrate measured results of another non-directional tap coupler, constructed in accordance with the present invention. The design was for a 1:30 unequal divider (1:30 is equivalent to −14.9 dB coupling value as reference to the input port). FIG. 6 shows that the coupling value is kept essentially constant and equal to the −15+/−0.8 dB value over 370 to 2700 MHz. FIG. 7 illustrates that the input return loss of the same non-directional tap coupler is kept below −23.15 dB, which corresponds to the VSWR of better that 1.15.

The present invention is not to be limited in scope by the specific embodiments described herein. Indeed, various modifications of the invention in addition to those described herein will become apparent to those skilled in the art from the foregoing description and the accompanying figures. Such modifications are intended to fall within the scope of the appended claims.

It is further to be understood that all values are to some degree approximate, and are provided for purposes of description.

The disclosures of any patents, patent applications, and publications that may be cited throughout this application are incorporated herein by reference in their entireties.

What is claimed is:

1. A non-directional tap coupler comprising:

a housing, said housing forming an outer coaxial conductor;

a dielectric within said housing;

a main transmission line defining a main conductor located concentrically within said dielectric; and a secondary transmission line defining a secondary conductor located concentrically within said housing and surrounding said main conductor, said secondary conductor having two ends and a length therebetween;

a side transmission line defining a side conductor connected to said secondary conductor;

wherein said side conductor connects perpendicular to the length of said secondary conductor; and wherein said side conductor connects at a point mid-way along the length of said secondary conductor and spaced equally from each of the two ends of said secondary conductor.

2. The coupler of claim 1, wherein said dielectric comprises air, gas, vacuum or other dielectric or combination thereof.

3. The coupler of claim 1, wherein said main conductor is essentially of a circular cross-section and connects directly an input port to an output port.

4. The coupler of claim 1, wherein said secondary conductor is of essentially cylindrical geometry and surrounds said main conductor over a substantial length inside said housing.

5. The coupler of claim 4, wherein said main conductor and said secondary conductor form a concentric structure which remains constant in size over a substantial length inside said housing.

6. The coupler of claim 5, wherein said side conductor is substantially perpendicular to said secondary conductor.

7. The coupler of claim 5, wherein said side conductor is connected to said secondary conductor at a point mid-way along a length of said housing.

8. The coupler of claim 5, wherein said side conductor forms a coaxial transmission line of essentially 50 ohm characteristic impedance.

9. The coupler of claim 1, wherein an impedance of said side conductor can be adjusted to compensate a slope of a coupling curve over a broadband frequency range.

10. The coupler of claim 1, wherein said housing includes:

a concentric hole along its long axis; and a second hole machined perpendicularly to said concentric hole.

11. The coupler of claim 1, wherein said secondary conductor is in proximity to said main conductor and said housing and influences a characteristic impedance and split ratio of the non-directional tap coupler.

* * * * *